US010022586B1

(12) United States Patent
Lee et al.

(10) Patent No.: US 10,022,586 B1
(45) Date of Patent: Jul. 17, 2018

(54) ELLIPTICAL EXERCISE MACHINE WITH A FRONT RESISTING UNIT

(71) Applicant: SUPERWEIGH ENTERPRISE CO., LTD., Nan-Tou Hsien (TW)

(72) Inventors: Sunny Lee, Nan-Tou Hsien (TW); Simon Chao, Nan-Tou Hsien (TW)

(73) Assignee: Superweigh Enterprise Co., LTD., Nan-Tou Hsien (TW)

( * ) Notice: Subject to any disclaimer, the term of this patent is extended or adjusted under 35 U.S.C. 154(b) by 0 days.

(21) Appl. No.: 15/624,998

(22) Filed: Jun. 16, 2017

(51) Int. Cl.

| | |
|---|---|
| ***A63B 22/04*** | (2006.01) |
| ***A63B 22/00*** | (2006.01) |
| ***A63B 21/22*** | (2006.01) |
| ***A63B 21/00*** | (2006.01) |
| ***A63B 22/06*** | (2006.01) |

(52) U.S. Cl.
CPC ..... *A63B 22/0046* (2013.01); *A63B 21/225* (2013.01); *A63B 21/4034* (2015.10); *A63B 21/4035* (2015.10); *A63B 21/4047* (2015.10); *A63B 22/0664* (2013.01); *A63B 2022/0676* (2013.01); *A63B 2225/09* (2013.01)

(58) Field of Classification Search
CPC ..... A63B 22/0046; A63B 22/0664; A63B 2022/0676; A63B 2022/0682; A63B 2022/0688
See application file for complete search history.

(56) References Cited

U.S. PATENT DOCUMENTS

| | | | | |
|---|---|---|---|---|
| 7,520,839 | B2 * | 4/2009 | Rodgers, Jr. | A63B 22/001 482/51 |
| 7,608,018 | B2 * | 10/2009 | Chuang | A63B 22/001 482/52 |
| 8,029,416 | B2 * | 10/2011 | Eschenbach | A63B 22/0017 482/52 |
| 8,814,757 | B2 * | 8/2014 | Eschenbach | A63B 21/00069 482/52 |
| 9,579,537 | B1 * | 2/2017 | Peng | A63B 22/0664 |
| 9,757,609 | B2 * | 9/2017 | Nishimura | A63B 22/001 |
| 9,827,461 | B1 * | 11/2017 | Miller | A63B 22/0664 |
| 9,901,774 | B2 * | 2/2018 | Miller | A63B 22/0664 |
| 2008/0261777 | A1 * | 10/2008 | Chuang | A63B 22/001 482/52 |
| 2008/0261778 | A1 * | 10/2008 | Chuang | A63B 22/001 482/52 |
| 2008/0261779 | A1 * | 10/2008 | Chuang | A63B 22/001 482/52 |
| 2009/0105049 | A1 * | 4/2009 | Miller | A63B 22/001 482/52 |

(Continued)

*Primary Examiner* — Joshua Lee
(74) *Attorney, Agent, or Firm* — LeClairRyan

(57) ABSTRACT

An elliptical exercise machine includes a resisting unit disposed at a front of a frame unit and having two cranks and a resisting member rotatable synchronously, two linking units each having a handle rod, an adjusting rod, a pedal rod, a swing rod, a first linking rod, a second linking rod and a third linking rod such that the pedal rod is suspended by the handle rod and the third linking rod to move along an elliptical route, and an adjusting unit having an adjusting tube which is pivotably connected to the adjusting rod and which is shiftable to adjust the position of the adjusting rod so as to adjust the elliptical route and the span between foot pedals on the pedal rods.

9 Claims, 10 Drawing Sheets

(56) References Cited

U.S. PATENT DOCUMENTS

| | | | | |
|---|---|---|---|---|
| 2009/0181828 | A1* | 7/2009 | Rodgers, Jr. | A63B 22/001 482/52 |
| 2013/0035212 | A1* | 2/2013 | Chuang | A63B 21/015 482/52 |
| 2013/0143720 | A1* | 6/2013 | Chuang | A63B 22/0664 482/52 |
| 2014/0194255 | A1* | 7/2014 | Huang | A63B 23/03591 482/52 |
| 2014/0194256 | A1* | 7/2014 | Huang | A63B 22/0664 482/52 |
| 2014/0221166 | A1* | 8/2014 | Huang | A63B 22/001 482/52 |
| 2014/0248998 | A1* | 9/2014 | Lu | A63B 21/154 482/52 |
| 2014/0248999 | A1* | 9/2014 | Lu | A63B 21/154 482/52 |
| 2014/0249000 | A1* | 9/2014 | Lu | A63B 22/0664 482/52 |
| 2015/0202488 | A1* | 7/2015 | Lo | A63B 22/001 482/52 |
| 2015/0335943 | A1* | 11/2015 | Miller | A63B 22/0664 482/52 |
| 2016/0375300 | A1* | 12/2016 | Chang | A63B 22/0664 482/52 |
| 2017/0014675 | A1* | 1/2017 | Lai | A63B 22/0664 |
| 2017/0080282 | A1* | 3/2017 | Lai | A63B 21/015 |

* cited by examiner

ELLIPTICAL EXERCISE MACHINE WITH A FRONT RESISTING UNIT

FIELD

The disclosure relates to an elliptical exercise machine, and more particularly to an elliptical exercise machine with a front resisting unit to provide a selectively variable elliptical motion by a user.

BACKGROUND

Referring to FIG. 1, a conventional front-mounted roller type elliptical exercise machine 1 includes a base 11, a resisting flywheel unit 12 disposed at a front of the base 11, a console 13 disposed above the resisting flywheel unit 12, a track seat 14 disposed rearwardly of the base 11, two transmitting rods 15 each having an end pivotably connected to the resisting flywheel unit 12 and an opposite end having a roller 18 that is slidable along the track seat 14, two pedal rods 16 pivotably connected to the transmitting rods 15, respectively, and two foot pedals 17 respectively affixed on rear ends of the pedal rods 16. When a user treads on the foot pedals 17, the rollers 18 roll along the track seat 14, which results in a reciprocating movement along an elliptical route of the pedal rods 16. However, the track seat 14 needs to be maintained by using lubricant to reduce friction and noise generated during rolling of the rollers 18. Furthermore, dirt and grime accumulation on the track seat 14 may adversely affect smoothness in operation and may shorten the service life of the machine 1.

Referring to FIG. 2, a conventional rear-mounted suspension type elliptical exercise machine 2 includes a base 21, a console 22 disposed at a front of the base 21, a resisting flywheel unit 23 disposed at a rear of the base 21, two pedal rods 24 pivotably connected to the resisting flywheel unit 23, and two foot pedals 25 respectively affixed on rear ends of the pedal rods 24. Due to the positions and orientations of the resisting flywheel unit 23 and the console 22, the elliptical exercise machine 2 is relative large and bulky. Moreover, the user can step on the foot pedals 25 only from two lateral sides of the base 21, which results in inconvenient usage.

SUMMARY

Therefore, an object of the disclosure is to provide an elliptical exercising device that can alleviate at least one of the drawbacks of the prior arts.

According to the disclosure, the elliptical exercise machine includes a frame unit, a resisting unit, two linking unit and an adjusting unit. The resisting unit is disposed at a front side of the frame unit, and includes two cranks which are rotatably mounted on the frame unit, a resisting member, and a transmitting mechanism which is connected between a respective one of the cranks and the resisting member to permit synchronous rotation of the cranks and the resisting member to provide a resistance to the cranks. Each of the linking units includes a handle rod which is pivotably connected to the frame unit, an adjusting rod which has one end pivotably connected to the handle rod, a pedal rod which has a front portion pivotably connected to a lower end of the handle rod and which extends rearwardly from the front portion to have a middle portion and a rear portion, a swing rod which is pivotably connected to the frame unit, a first linking rod which is pivotably connected to the adjusting rod and the respective one of the cranks, a second linking rod which has an end pivotably connected to the respective one of the cranks about an axis coaxial with that of the first linking rod and an opposite end pivotably connected to the swing rod, and a third linking rod which is pivotably connected to the swing rod and the middle portion of the pedal rod and which cooperates with the handle rod to suspend the pedal rod. The adjusting unit is disposed on the frame unit, and includes an adjusting tube which is shiftable relative to an upper portion of the frame unit between an upper limit position and a lower limit position. The adjusting rod has an opposite end which is pivotably connected to the adjusting tube to be moved with the adjusting tube between the upper limit position, where a pivot point of the adjusting tube and the adjusting rod is proximate to the upper portion of the frame unit, and the lower limit position, where the pivot point of the adjusting tube and the adjusting rod is distal from the upper portion of the frame unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
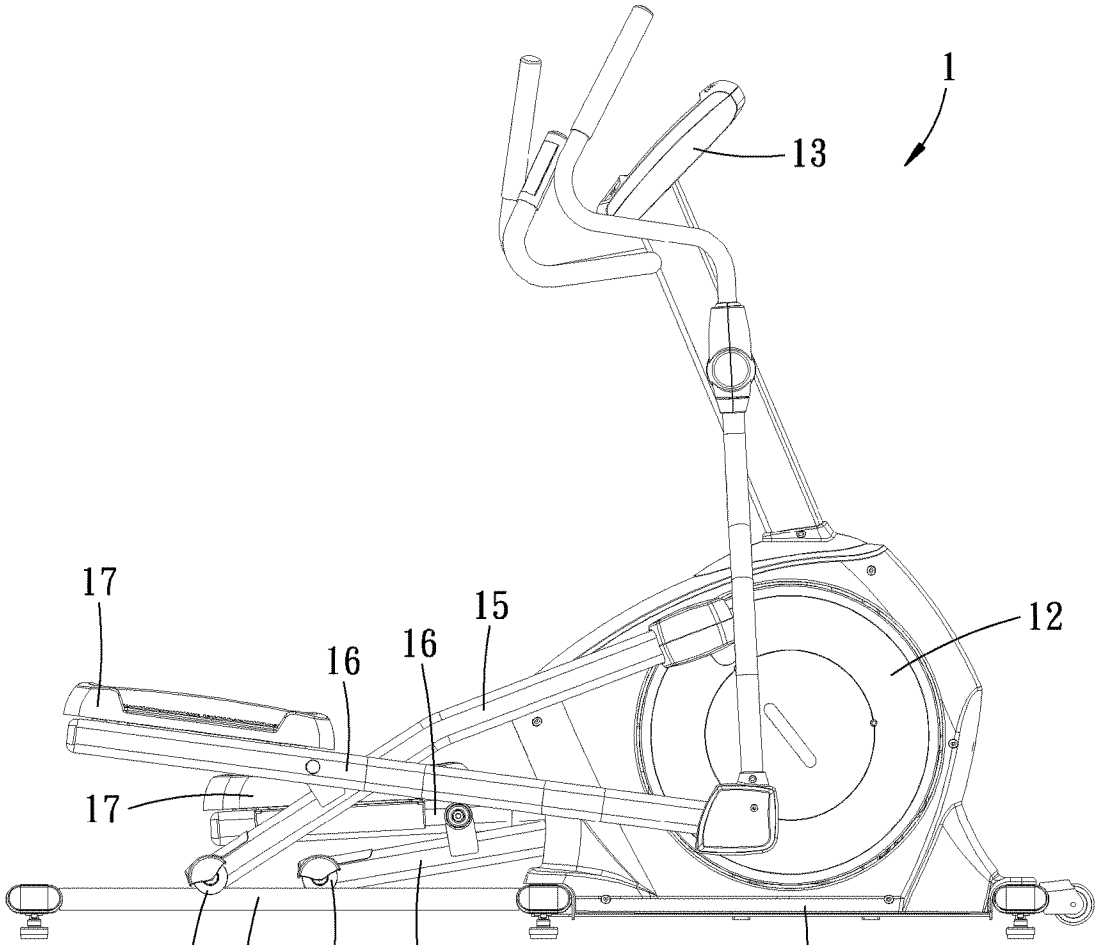
FIG. 1 PRIOR ART
FIG. 1 is a side view of a conventional elliptical exercise machine.
Figure 2:
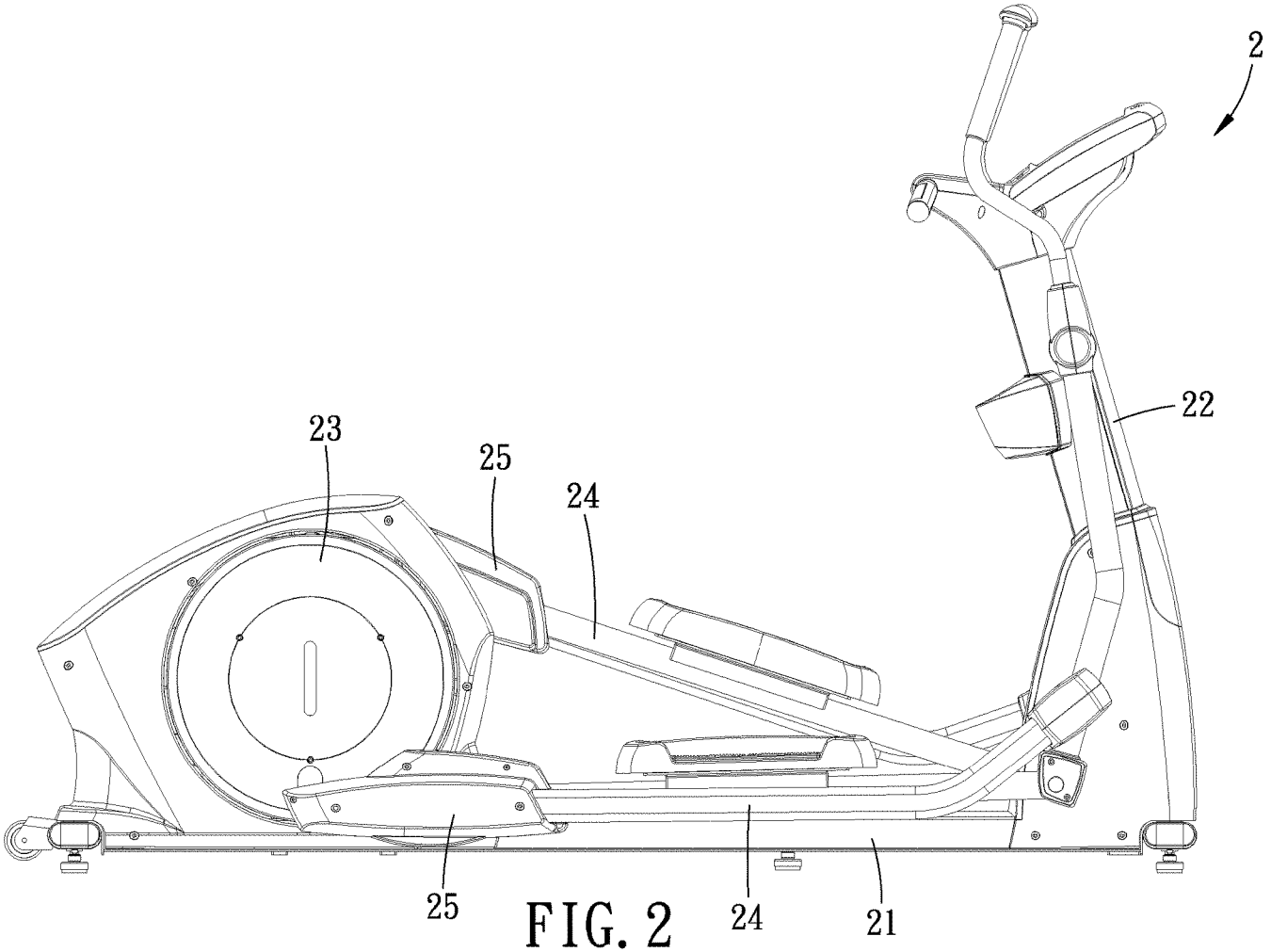
FIG. 2 PRIOR ART
FIG. 2 is a side view of another conventional elliptical exercise machine.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
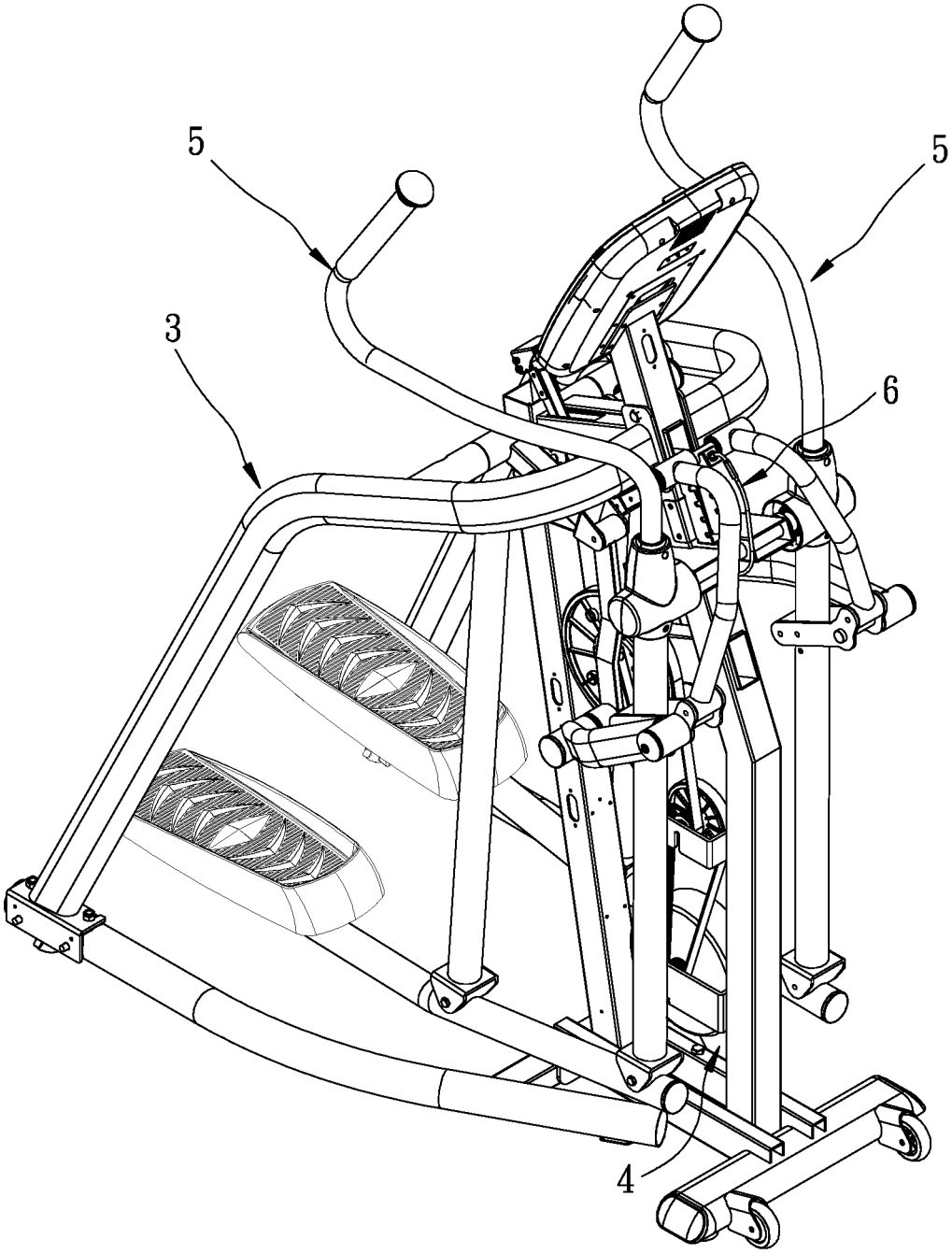
FIG. 3 is a perspective view illustrating an embodiment of an elliptical exercise machine according to the disclosure.

Referring to FIG. 3, an embodiment of an elliptical exercise machine according to the disclosure includes a frame unit 3, a resisting unit 4, two linking units 5 and an adjusting unit 6.

Figure 4:
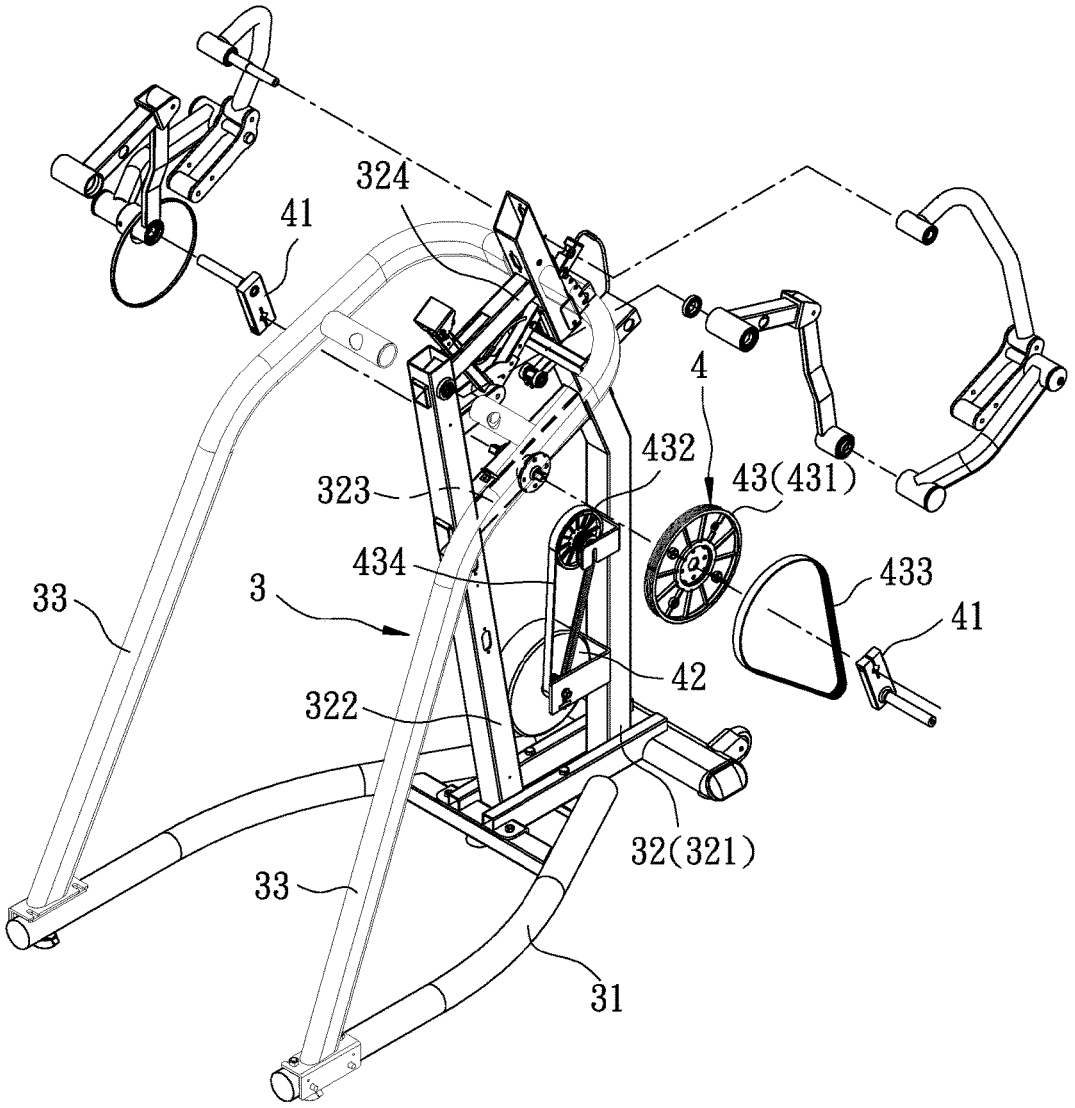
FIG. 4 is a partly exploded perspective view of the embodiment.

Referring to FIG. 4, the frame unit 3 includes a base 31, an upper front support 32 disposed on a front side of the base 31 and standing upwardly, and two lateral supports 33 each connected between a rear side of the base 31 and an upper side of the upper front support 32. The upper front support 32 has a front rod section 321 which extends upwardly, a rear rod section 322 which extends upwardly and which is disposed rearwardly of the front rod section 321, a middle crosspiece section 323 which is connected between the front and rear rod sections 321, 322, and an upper crosspiece section 324 which is connected between the front and rear rod sections 321, 322 and which is disposed upwardly of the middle crosspiece section 323.

The resisting unit 4 is disposed on a front of the frame unit 3, and includes two cranks 41 which are rotatably mounted on, such as pivotably connected to, the middle crosspiece section 323, a resisting member 42 in a form of a flywheel which is rotatably mounted on, such as pivotably connected to, the front rod section 321, and a transmitting mechanism 43 which is connected between a respective one of the cranks 41 and the resisting member 42 to permit synchronous rotation of the cranks 41 and the resisting member 42 to provide a resistance to the cranks 41. Specifically, the transmitting mechanism 43 has a first wheel 431 which is pivotably connected to the middle crosspiece section 323 about an axis coaxial with that of the cranks 41, a second wheel 432 which is pivotably connected to the front rod section 321, a first belt 433 which is trained on the first and second wheels 431, 432, and a second belt 434 which is trained on the second wheel 432 and the resisting member 42.

Figure 5:
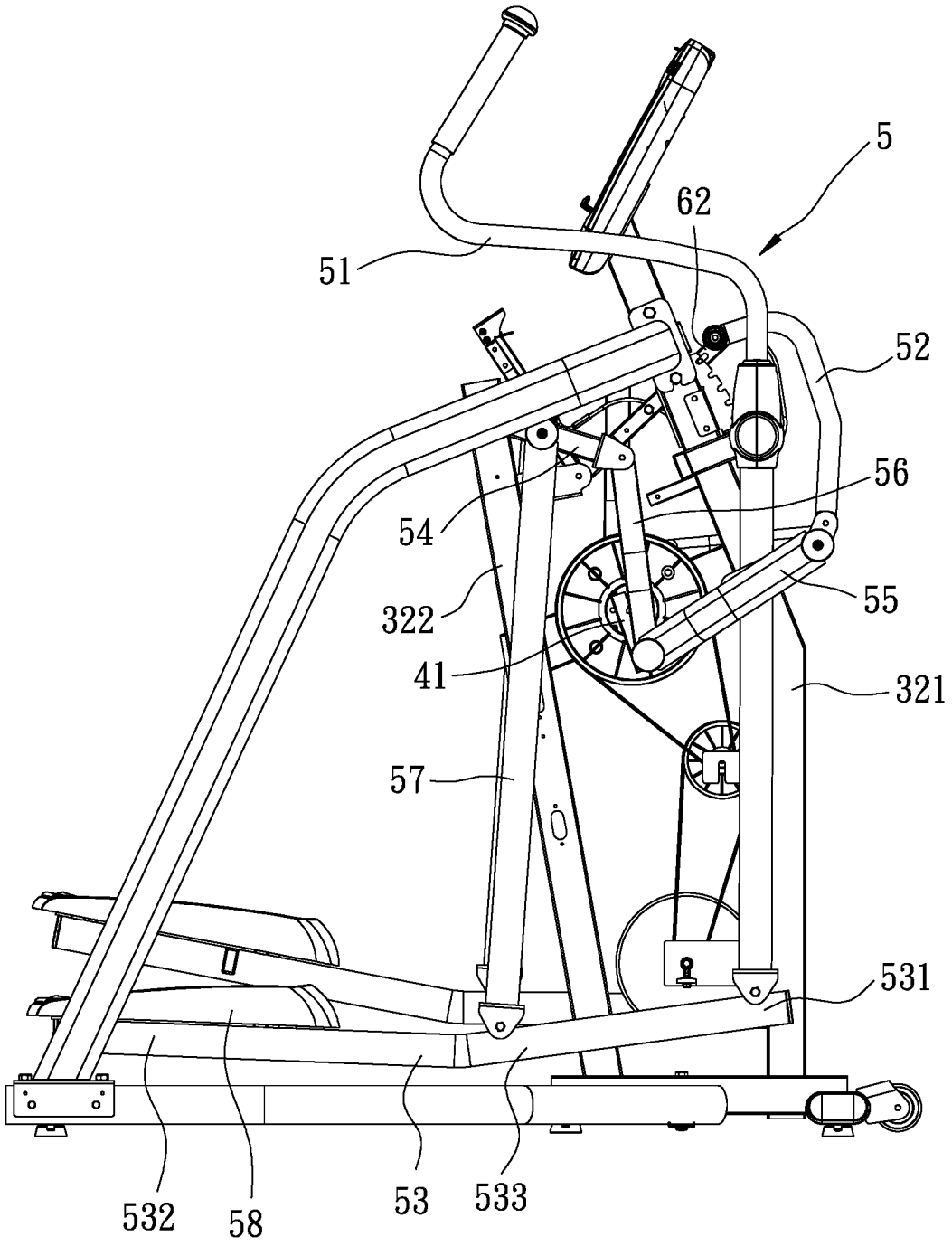
FIG. 5 is a side view of the embodiment.

Referring to FIGS. 3 and 5, each linking unit 5 includes a handle rod 51 which is pivotably connected to the front rod section 321 and which extends upwardly and downwardly to have an upper handgrip end and a lower end, an adjusting rod 52 which has one end pivotably connected to the handle rod 51, a pedal rod 53 which has a front portion 531 pivotably connected to the lower end of the handle rod 51 and which extends rearwardly from the front portion 531 to have a middle portion 533 and a rear portion 532, a swing rod 54 which is pivotably connected to the rear rod section 322, a first linking rod 55 which is pivotably connected to the adjusting rod 52 and the respective crank 41, a second linking rod 56 which has an end pivotably connected to the respective crank 41 about an axis coaxial with that of the first linking rod 55 and an opposite end pivotably connected to the swing rod 54, a third linking rod 57 which is pivotably connected to the swing rod 54 and the middle portion 533 of the pedal rod 53 and which cooperates with the handle rod 51 to suspend the pedal rod 53, and a foot pedal 58 which is disposed on the rear portion 532 of the pedal rod 53.

Figure 6:
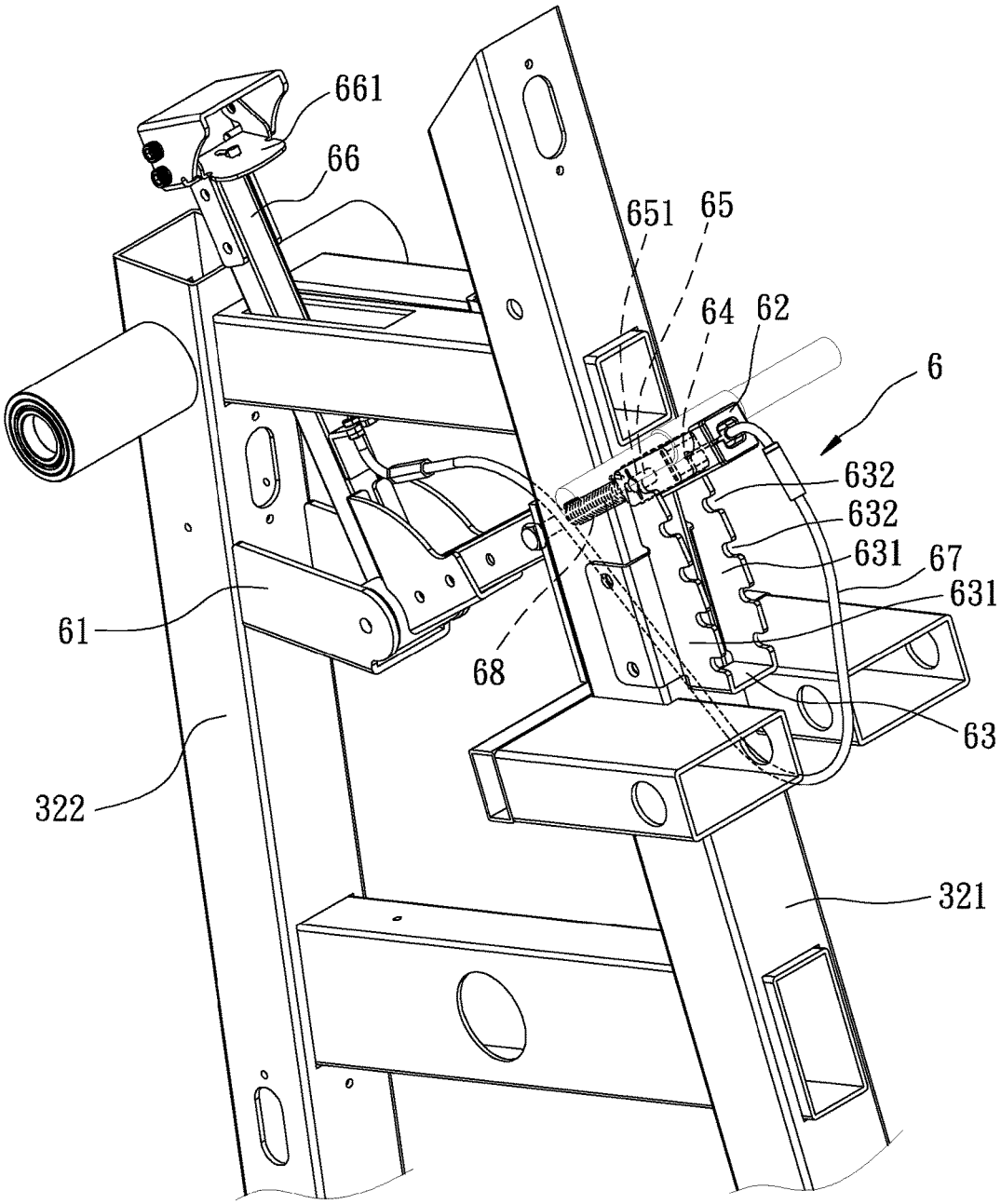
FIG. 6 is a fragmentary perspective view illustrating an adjusting unit mounted on a frame unit of the embodiment.
Figure 7:
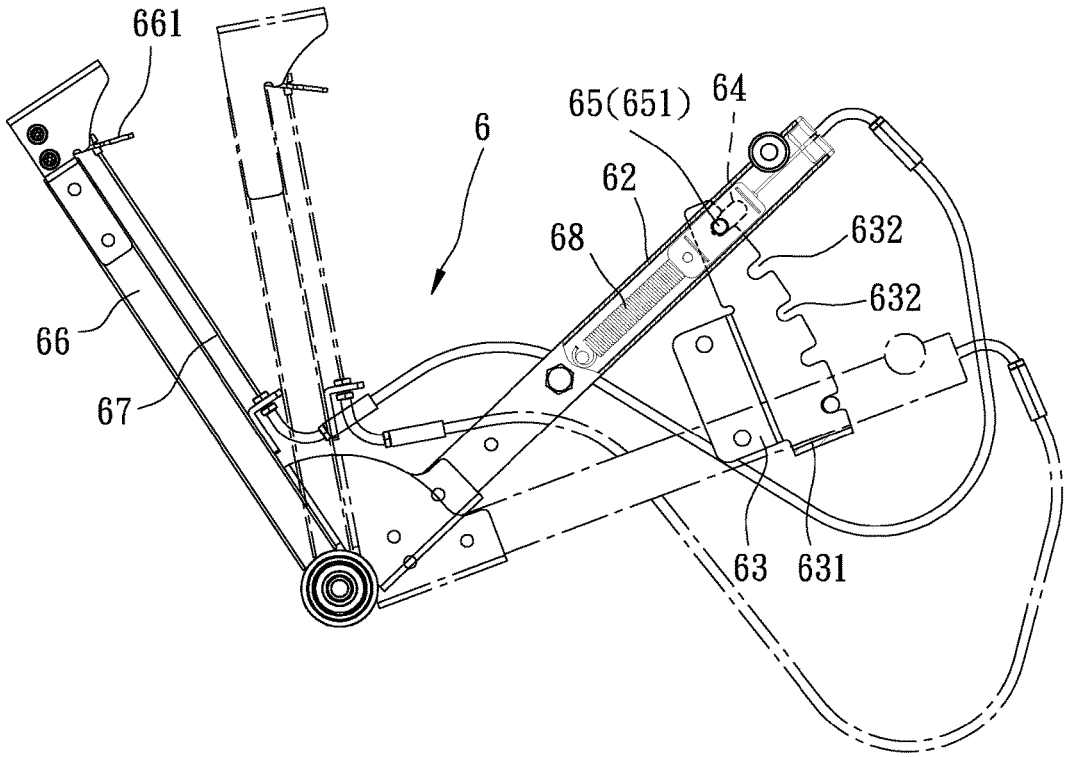
FIG. 7 is a schematic side view illustrating the adjusting unit.

Referring to FIGS. 5 to 7, the adjusting unit 6 includes a pivot seat 61 which is disposed on the rear rod section 322, an adjusting tube 62 which has a pivot end pivotably connected to the pivot seat 61 so as to permit the adjusting tube 62 to be turned relative to the pivot seat 61 between an upper limit position and a lower limit position, a retaining seat 63 which is disposed on the front rod section 321, a movable member 64 which is disposed in and movable along the adjusting tube 62, a retained pin 65 which is disposed on the movable member 64 to be moved to be retained to the retaining seat 63, an adjusting handle 66 which has a pivot end pivotably connected to the pivot seat 61 about an axis coaxial with that of the adjusting tube 62 and connected with the adjusting tube 62, and an operated end operable manually to turn the adjusting tube 62, a releasing cable 67 which has an end connected to the movable member 64 and an opposite end disposed adjacent to the adjusting handle 66 to be pulled to permit disengagement of the retained pin 65 from the retaining seat 63, and a biasing spring 68 which is disposed to bias the movable member 64 toward the retaining seat 63. Specifically, the retaining seat 63 has two side walls 631 which are disposed parallel to and spaced apart from each other and each of which has a plurality of retaining grooves 632 spaced apart from each other. The retained pin 65 has two end portions 651 which are disposed to be respectively retained in selected ones of the retaining grooves 632 of the side walls 631 so as to retain the adjusting tube 62 at a desired position relative to the frame unit 3. A pull lever 661 is connected to the releasing cable 67 and is disposed adjacent to the operated end of the adjusting handle 66 so as to facilitate pulling of the releasing cable 67.

Figure 8:
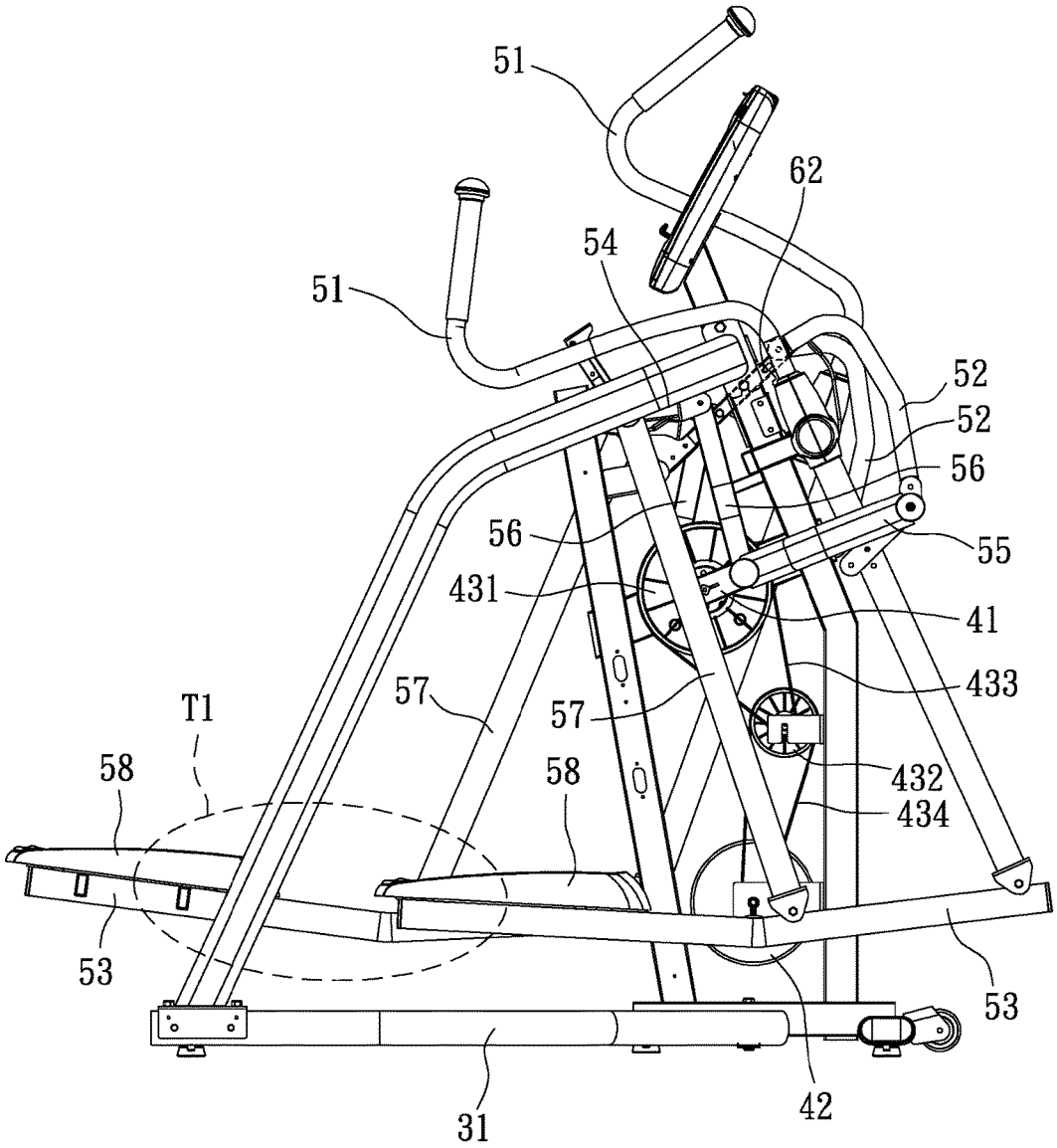
FIG. 8 is a side view illustrating an adjusting tube of the adjusting unit at an upper limit position, where a span between foot pedals is the largest.
Figure 9:
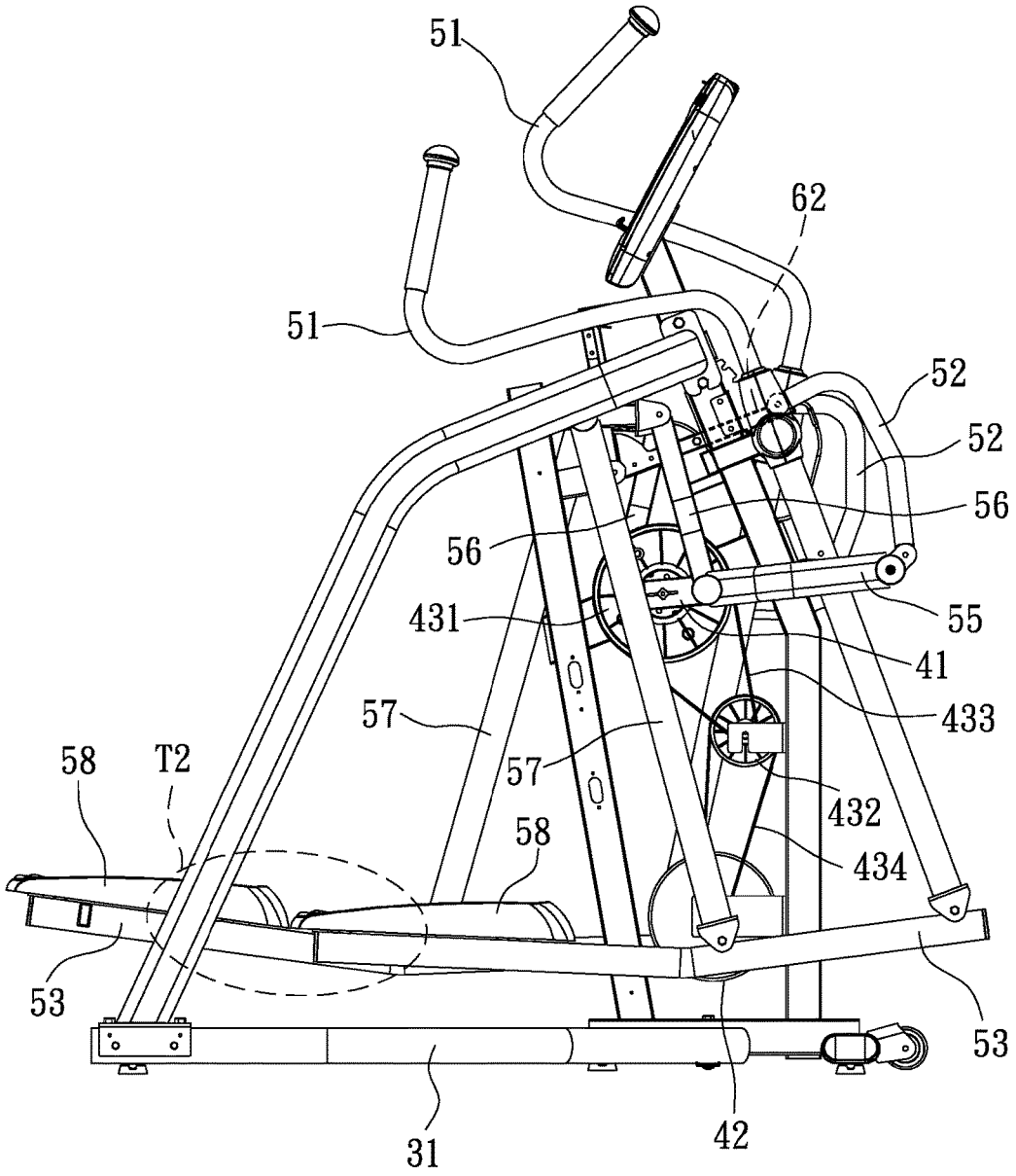
FIG. 9 is a side view similar to FIG. 8, illustrating the adjusting tube at a lower limit position, where the span is the smallest.

With reference to FIGS. 7 to 9, the adjusting rod 52 of each linking unit 5 has an opposite end which is pivotably connected to the adjusting tube 62 and remote from the pivot end of the adjusting tube 62 to be moved with the turning of adjusting tube 62 between the upper limit position (as shown in FIG. 8), where a pivot point of the adjusting tube 62 and the adjusting rod 52 is proximate to the upper portion of the frame unit 3, and the lower limit position (as shown in FIG. 9), where the pivot point of the adjusting tube 62 and the adjusting rod 52 is distal from the upper portion of the frame unit 3.

Referring to FIGS. 6 to 9, when a user stands on the foot pedals 58 with hands grasping the upper handgrip ends of the handle rods 51, and exerts a force on the foot pedals 58 in an alternating manner, the third linking rods 57 are swung forwardly and rearwardly with the pedal rods 53, and the swing rods 54 are swung upwardly and downwardly to result in an elliptical motion of the foot pedals 58, thereby enabling in the user's feet to travel along an elliptical route. Meanwhile, the cranks 41 are rotated due to the interconnections of the second linking rods 56 and the first linking rods 55 described above, and the resisting member 42 is rotated as well by the transmitting mechanism 43 to provide a resistance to the cranks 41.

When it is desired to adjust the span between the foot pedals 58 to change the elliptical route, the pull lever 661 is pulled to permit disengagement of the retained pin 65 from the retaining grooves 632 of the retaining seat 63. Then, the adjusting handle 66 is operated to turn the adjusting tube 62 to a desired height position. The adjusting handle 66 is retained in place when the pull lever 661 is released and the movable member 64 is moved toward the retaining seat 63 by means of the biasing spring 68. The adjusting rod 52 is moved with the turning of the adjusting tube 62 to vary the elliptical route and the span between the foot pedals 58. For example, when the adjusting tube 62 is at the upper limit position (see FIG. 8), the elliptical motion track (T1) of the pedals 58 has a longest long axis. When the adjusting tube 62 is at the lower limit position (see FIG. 9), the elliptical motion track (T2) of the pedals 58 has a shortest long axis.

Further, with the suspension of the pedal rod 53 by the handle rod 51 and the third linking rod 57, the foot pedals 58 are kept in a horizontal position during the elliptical route to provide a smoother and comfortable stepping motion.

As illustrated, since the linking units 5 are disposed on the frame unit 3 in a pivotable connection manner, compared to the aforementioned conventional front-mounted roller type elliptical machine 1 (see FIG. 1), the linking units 5 of the disclosure produce less noise during operation and do not need to be maintained frequently with the use of lubricant, and the service life of the elliptical exercise machine is prolonged. With the arrangement of the resisting unit 4 being mounted on a front side of the frame unit 3, the length of the entire elliptical exercise machine is decreased and less space is occupied thereby. In addition, the user can step on the foot pedals 58 from the rear side of the base 31 for convenient operation. By adjusting the position of the adjusting tube 62 relative to the frame unit 3 to change the position of the adjusting rod 52, the elliptical route and the span between the foot pedals 58 can be adjusted to suit different operators' needs. Furthermore, the foot pedals 58 are kept in a horizontal position during the elliptical route to provide a smoother and comfortable stepping motion.

Figure 10:
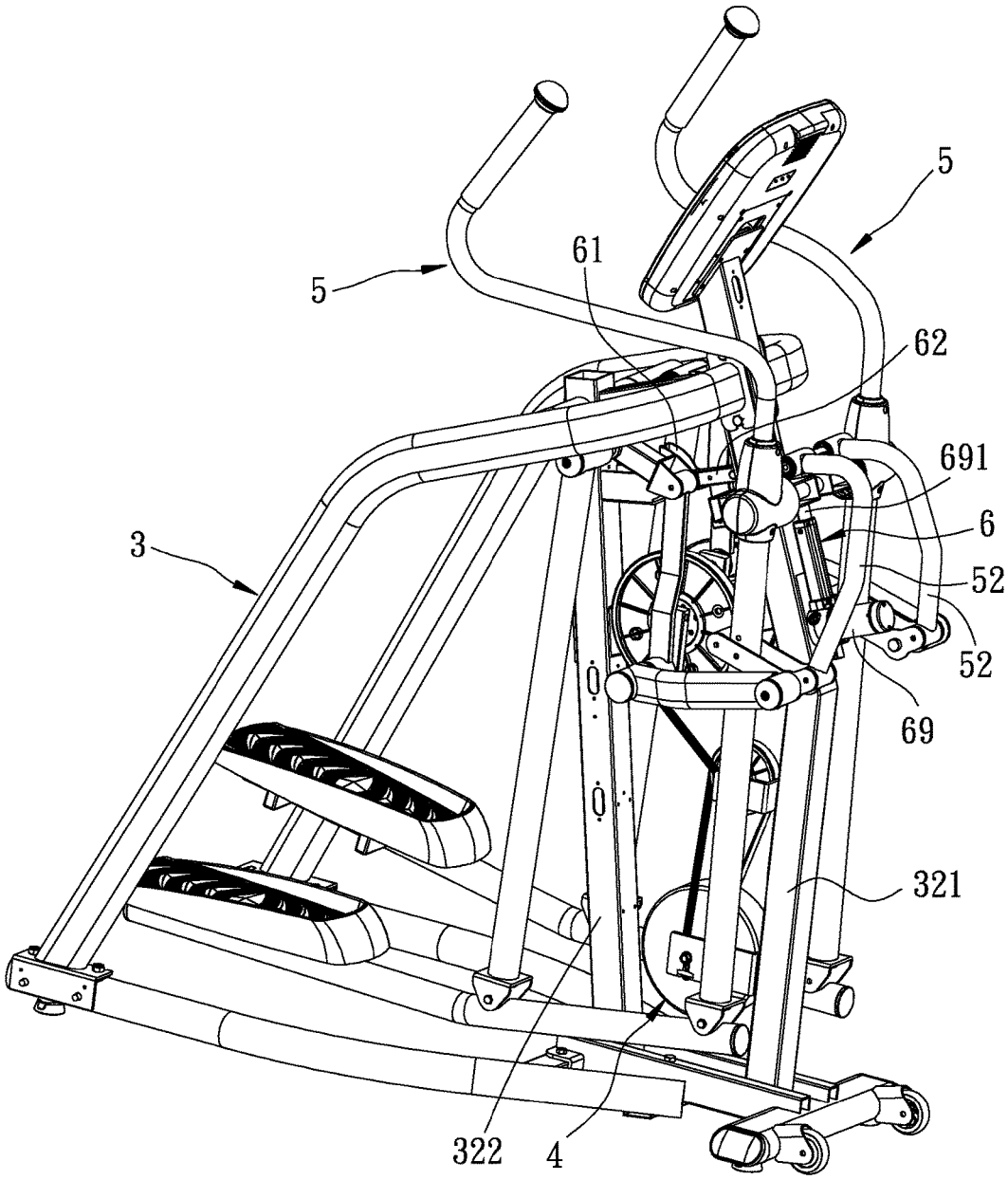
FIG. 10 is a perspective view illustrating another embodiment of the elliptical exercise machine according to the disclosure.

As shown in FIG. 10, in another embodiment, the adjusting unit 6 includes a pivot seat 61 disposed on the rear rod section 322, and a driving motor 69 disposed on the front rod section 321. The adjusting tube 62 has a pivot end which is remote from the adjusting rod 52 and which is pivotably connected to the pivot seat 61 so as to permit the adjusting tube 62 to be turned relative to the pivot seat 61. The driving motor 69 has a piston 691 which is connected to the adjusting tube 62 to actuate turning of the adjusting tube 62 between the upper and lower limit positions.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An elliptical exercise machine comprising:

a frame unit;

a resisting unit disposed at a front side of said frame unit, and including two cranks which are rotatably mounted on said frame unit, a resisting member, and a transmitting mechanism which is connected between a respective one of said cranks and said resisting member to permit synchronous rotation of said cranks and said resisting member to provide a resistance to said cranks;

two linking units, each including a handle rod which is pivotably connected to said frame unit, an adjusting rod which has one end pivotably connected to said handle rod, a pedal rod which has a front portion pivotably connected to a lower end of said handle rod and which extends rearwardly from said front portion to have a middle portion and a rear portion, a swing rod which is pivotably connected to said frame unit, a first linking rod which is pivotably connected to said adjusting rod and the respective one of said cranks, a second linking rod which has an end pivotably connected to the respective one of said cranks about an axis coaxial with that of said first linking rod and an opposite end pivotably connected to said swing rod, and a third linking rod which is pivotably connected to said swing rod and said middle portion of said pedal rod and which cooperates with said handle rod to suspend said pedal rod; and an adjusting unit disposed on said frame unit, and including an adjusting tube which is shiftable relative to an upper portion of said frame unit between an upper limit position and a lower limit position, said adjusting rod of each of said linking units having an opposite end which is pivotably connected to said adjusting tube to be moved with said adjusting tube between the upper limit position, where a pivot point of said adjusting tube and said adjusting rod is proximate to said upper portion of said frame unit, and the lower limit position, where the pivot point of said adjusting tube and said adjusting rod is distal from said upper portion of said frame unit.

2. The elliptical exercise machine as claimed in claim 1, wherein said frame unit includes a base, an upper front support disposed on a front side of said base, and two lateral supports each connected between said base and said upper front support, said upper front support including a front rod section which extends upwardly, a rear rod section which extends upwardly and which is disposed rearwardly of said front rod section, a middle crosspiece section which is connected between said front and rear rod sections, and an upper crosspiece section which is connected between said front and rear rod sections and which is disposed upwardly of said middle crosspiece section, said cranks being pivotably connected to said middle crosspiece section, said resisting member being pivotably connected to said front rod section.

3. The elliptical exercise machine as claimed in claim 2, wherein said adjusting unit further includes a pivot seat disposed on said rear rod section, a retaining seat disposed on said front rod section, a movable member disposed in and movable along said adjusting tube, and a retained pin disposed on said movable member to be moved to be retained to said retaining seat, said adjusting tube having a pivot end which is remote from said adjusting rod and which is pivotably connected to said pivot seat so as to permit said adjusting tube to be turned relative to said pivot seat between the upper and lower limit positions.

4. The elliptical exercise machine as claimed in claim 3, wherein said retaining seat has two side walls which are disposed parallel to and spaced apart from each other and each of which has a plurality of retaining grooves spaced apart from each other, said retained pin having two end portions which are disposed to be respectively retained in selected ones of said retaining grooves of said side walls.

5. The elliptical exercise machine as claimed in claim 4, wherein said adjusting unit further includes an adjusting handle having a pivot end which is pivotably connected to said pivot seat about an axis coaxial with that of said adjusting tube and which is connected with said adjusting tube, and an operated end which is operable manually to turn said adjusting tube, a releasing cable having an end which is connected to said movable member and an opposite end which is disposed adjacent to said adjusting handle to be pulled to permit disengagement of said retained pin from said retaining seat, and a biasing spring disposed to bias said movable member toward said retaining seat.

6. The elliptical exercise machine as claimed in claim 2, wherein said adjusting unit further includes a pivot seat disposed on said rear rod section, and a driving motor disposed on said front rod section, said adjusting tube having a pivot end which is remote from said adjusting rod and which is pivotably connected to said pivot seat so as to permit said adjusting tube to be turned relative to said pivot seat, said driving motor having a piston which is connected to said adjusting tube to actuate turning of said adjusting tube between the upper and lower limit positions.

7. The elliptical exercise machine as claimed in claim 2, wherein said transmitting mechanism has a first wheel which is pivotably connected to said middle crosspiece section about an axis coaxial with that of said cranks, a second wheel which is pivotably connected to said front rod section, a first belt which is trained on said first and second wheels, and a second belt which is trained on said second wheel and said resisting member.

8. The elliptical exercise machine as claimed in claim 2, wherein said handle rod and said swing rod of each of said linking unit are pivotably connected to said front rod section and said rear rod section, respectively.

9. The elliptical exercise machine as claimed in claim 1, wherein each of said linking units further includes a foot pedal disposed on said rear portion of said pedal rod.

* * * * *